US007517254B2

(12) United States Patent
Zhang et al.

(10) Patent No.: US 7,517,254 B2
(45) Date of Patent: Apr. 14, 2009

(54) MODULAR JACK ASSEMBLY HAVING IMPROVED BASE ELEMENT

(75) Inventors: Hong-Bo Zhang, Kunshan (CN); Zheng-Hua Xu, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,794

(22) Filed: Mar. 5, 2008

(65) Prior Publication Data

US 2008/0220656 A1 Sep. 11, 2008

(30) Foreign Application Priority Data

Mar. 5, 2007 (CN) ..... 2007 1 0020213

(51) Int. Cl.
*H01R 24/04* (2006.01)

(52) U.S. Cl. ..... 439/668; 439/76.1; 439/541.5

(58) Field of Classification Search ..... 439/76.1, 439/541.5, 607, 668
See application file for complete search history.

(56) References Cited

U.S. PATENT DOCUMENTS 6,976,877 B2 * 12/2005 Lien ..... 439/620.01
7,033,210 B1 * 4/2006 Laurer et al. ..... 439/541.5
7,052,315 B2 5/2006 Murr et al.
7,153,158 B1 * 12/2006 Lee ..... 439/541.5
2004/0203280 A1 * 10/2004 Chang ..... 439/541.5
2007/0010131 A1 * 1/2007 Chen ..... 439/541.5
2007/0015402 A1 * 1/2007 Lee ..... 439/541.5
2008/0194140 A1 * 8/2008 Zhang et al. ..... 439/540.1
2008/0214057 A1 * 9/2008 Zhang et al. ..... 439/668
2008/0220656 A1 * 9/2008 Zhang et al. ..... 439/668

* cited by examiner

*Primary Examiner*—James Harvey
(74) *Attorney, Agent, or Firm*—Wei Te Chung

(57) ABSTRACT

A modular jack assembly (1) for being mounted on a mother board (4) and engaging with a mating plug. The modular jack has a number of terminal modules (3), an insulative housing (2), an outer shield (6) surrounding the insulative housing (2) and a power over ethernet assembly (33). The terminal module is provided with a base element (310) having a front portion (3101), a rear portion (3102), a top portion (3103), a side portion (3107) and a number of connecting terminals (35) mounted thereon. The terminal module further includes a pair of daughter boards (311) attached to the side portions of the base element, a contacting module (30) assembled to the front portion and a connecting element (32) mounted to the rear portion.

15 Claims, 8 Drawing Sheets

MODULAR JACK ASSEMBLY HAVING IMPROVED BASE ELEMENT

CROSS-REFERENCE TO RELATED APPLICATION

The present application is related to commonly assigned and concurrently filed U.S. patent application entitled "MODULAR JACK ASSEMBLY HAVING IMPROVED CONNECTING TERMINAL" with an unknown serial number.

BACKGROUND OF THE INVENTION

1. Field of the Invention

The present invention relates to a modular jack assembly and particularly to a modular jack assembly comprising a terminal module having an improved base element.

2. Description of the Prior Art

Modular jack assembly is commonly used in the computer or network appliance as input/output port for transmitting data or signals. An example of such a connector is disclosed in U.S. Pat. No. 7,052,315 issued on May 30, 2006. The modular jack assembly has a power over ethernet assembly attached to a rear portion thereof. The conventional modular jack assembly includes an insulative housing having a cavity, a terminal module received in the cavity, an outer shield surrounding the housing and a main board mounted to the rear portion of the insulative housing. The terminal module includes a base element defining a receiving room and a conductive portion assembled in a front wall of the base element. The base element comprises a daughter board positioned on a top thereof. The terminal module has a plurality of L-shaped signal contacts and power contacts. The L-shaped contacts have first ends routing through the daughter board and second ends extending outwardly from a rear wall of the base element and then through the main board for connecting with the power over ethernet assembly. The modular jack assembly further comprises a connector mounted behind the main board for connecting the power over ethernet assembly to the main board.

However, the main board and the power over ethernet assembly are both mounted to a rear portion of the base element. Too much space will then be taken by the modular jack assembly along the front-to-back direction.

Hence, an improved modular jack assembly is needed to solve the above problem.

BRIEF SUMMARY OF THE INVENTION

One object of the present invention is to provide a modular jack assembly comprising a terminal module having an improved base element adapted for directly interconnecting with a mother board and a power over ethernet assembly at different portions of the modular jack assembly.

The modular jack assembly for being mounted to a mother board and engaging with a plurality of mating plugs comprises a plurality of terminal modules and a rearwardly mounted power over ethernet assembly. The terminal module comprises a base element, a pair of daughter boards, a contacting module and a connecting element. The base element comprises a front portion, a top portion, a bottom portion, a rear portion, a side portion, a receiving room defined therein and a plurality of connecting terminals mounted thereon and electrically connected with the power over ethernet assembly. The pair of daughter boards are attached to opposite sides of the base element and have a conductive region electrically connected with the power over ethernet assembly. The contacting module is assembled to the front portion of the base element and has two groups of mating terminals mounted thereon. Each group of mating terminals have contacting portions contacting with the mating plug and tail portions electrically connected to the conductive region of corresponding daughter board. The connecting element is mounted below the bottom portion of the base element and has two rows of contacts assembled thereto. Each row of the contacts have soldering portions soldered onto the mother board and bending portions electrically connected to the conductive region of corresponding daughter board.

The power over ethernet and the mother board are respectively mounted at the rear portion and the bottom portion of the modular jack assembly, via the connecting terminals mounted between the daughter board and the power over ethernet assembly, and the contacts mounted between the mother board and the daughter board. Therefore, it would occupy smaller space along the front-to-back direction by the modular jack assembly. Such a modular jack assembly would comply with a miniature trend as the customers require.

Other objects, advantages and novel features of the invention will become more apparent from the following detailed description of the present embodiments when taken in conjunction with the accompanying drawings.

DETAILED DESCRIPTION OF THE INVENTION

Figure 1:
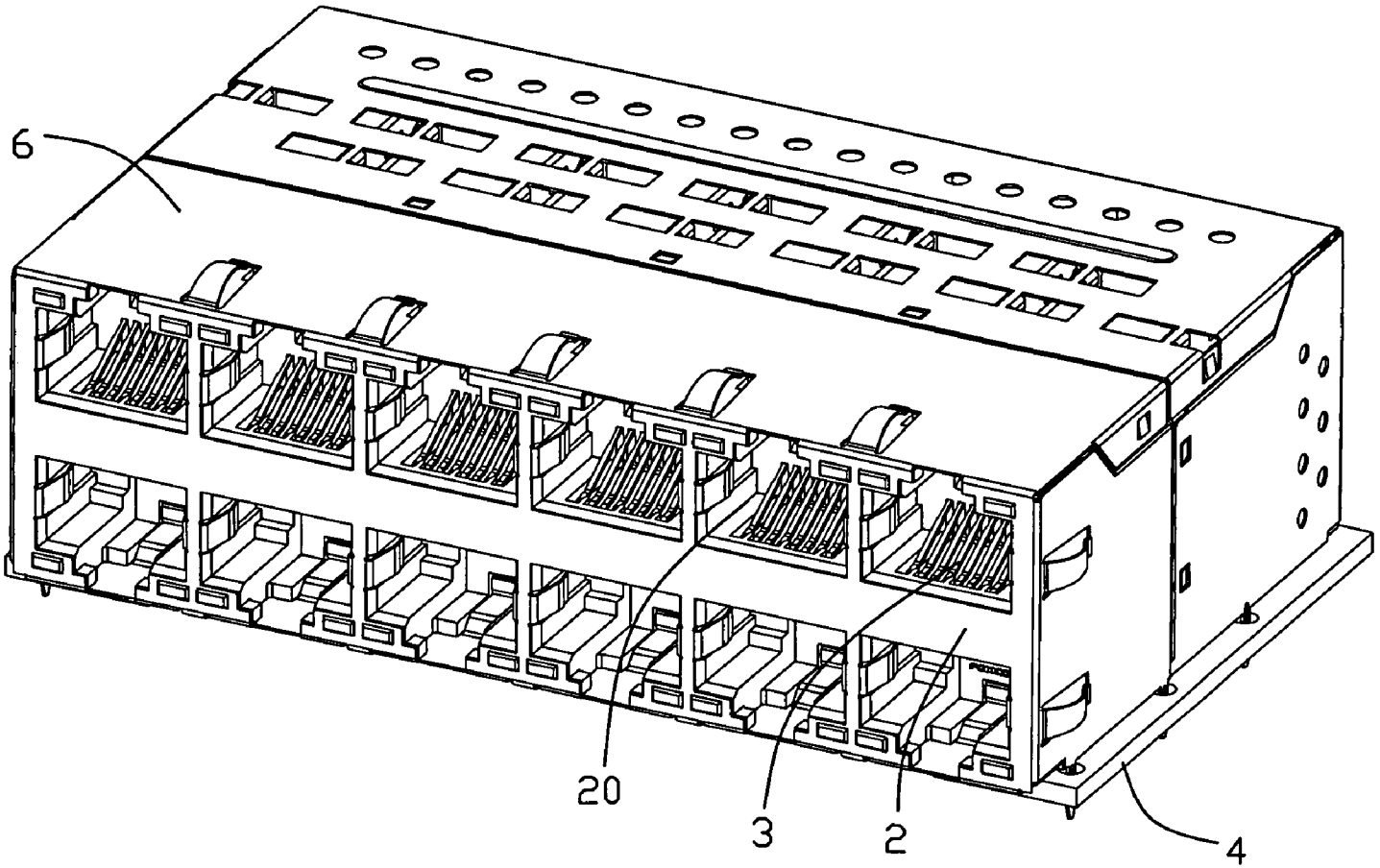
FIG. 1 is an assembled perspective view of a modular jack assembly mounted on a mother board, according to the present invention.
Figure 2:
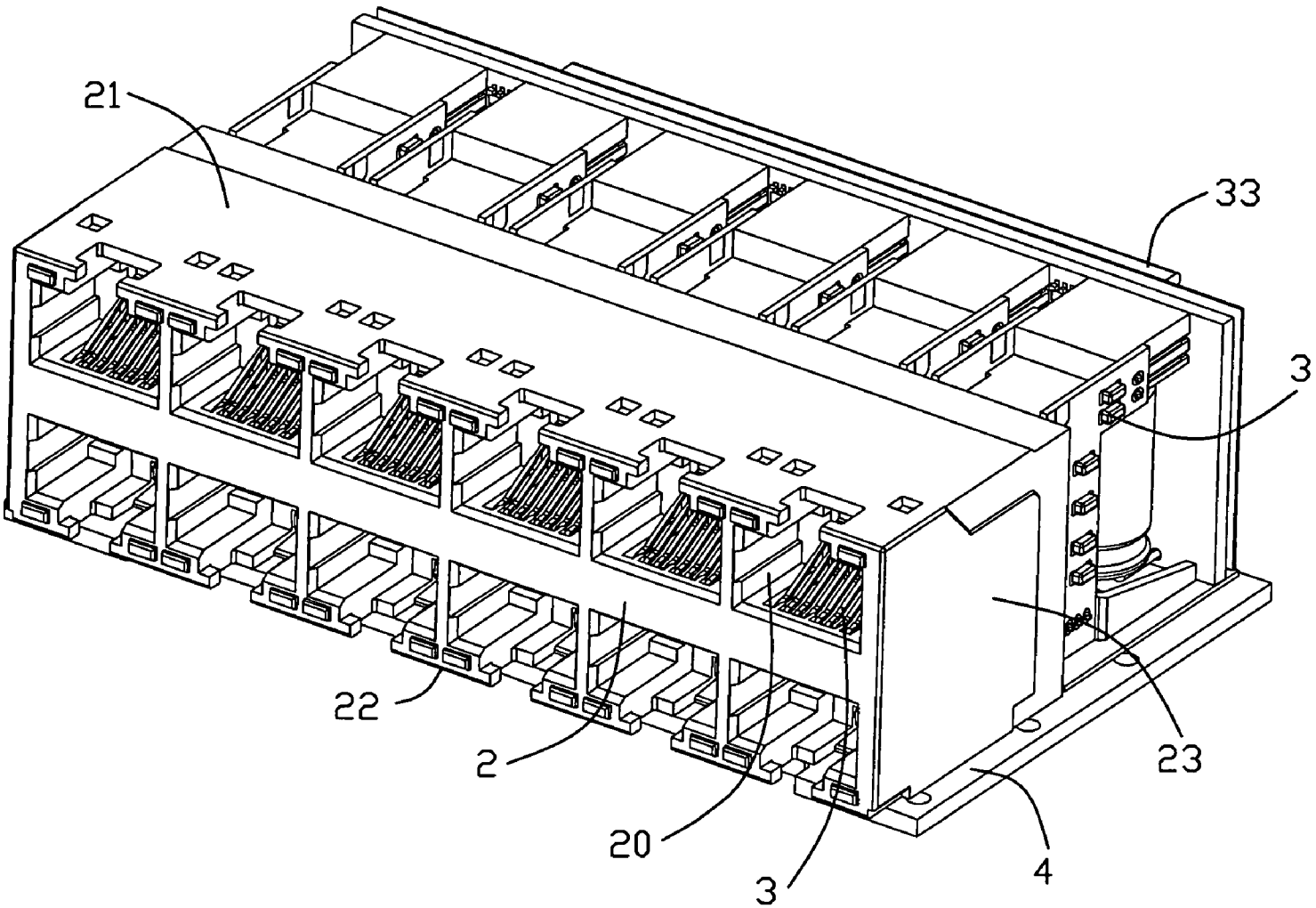
FIG. 2 is a perspective view of the modular jack assembly mounted on the mother board as shown in FIG. 1, with an outer shield being removed.

Reference will now be made to the drawing figures to describe the present invention in detail. Referring to FIGS. 1 and 2, a modular jack assembly 1 for being mounted on a mother board 4 and engaging with a mating plug (not shown). The modular jack assembly comprises a plurality of terminal modules 3, an insulative housing 2, an outer shield 6 surrounding the insulative housing 2, a power over ethernet assembly 33 and a terminal module 3.

Figure 3:
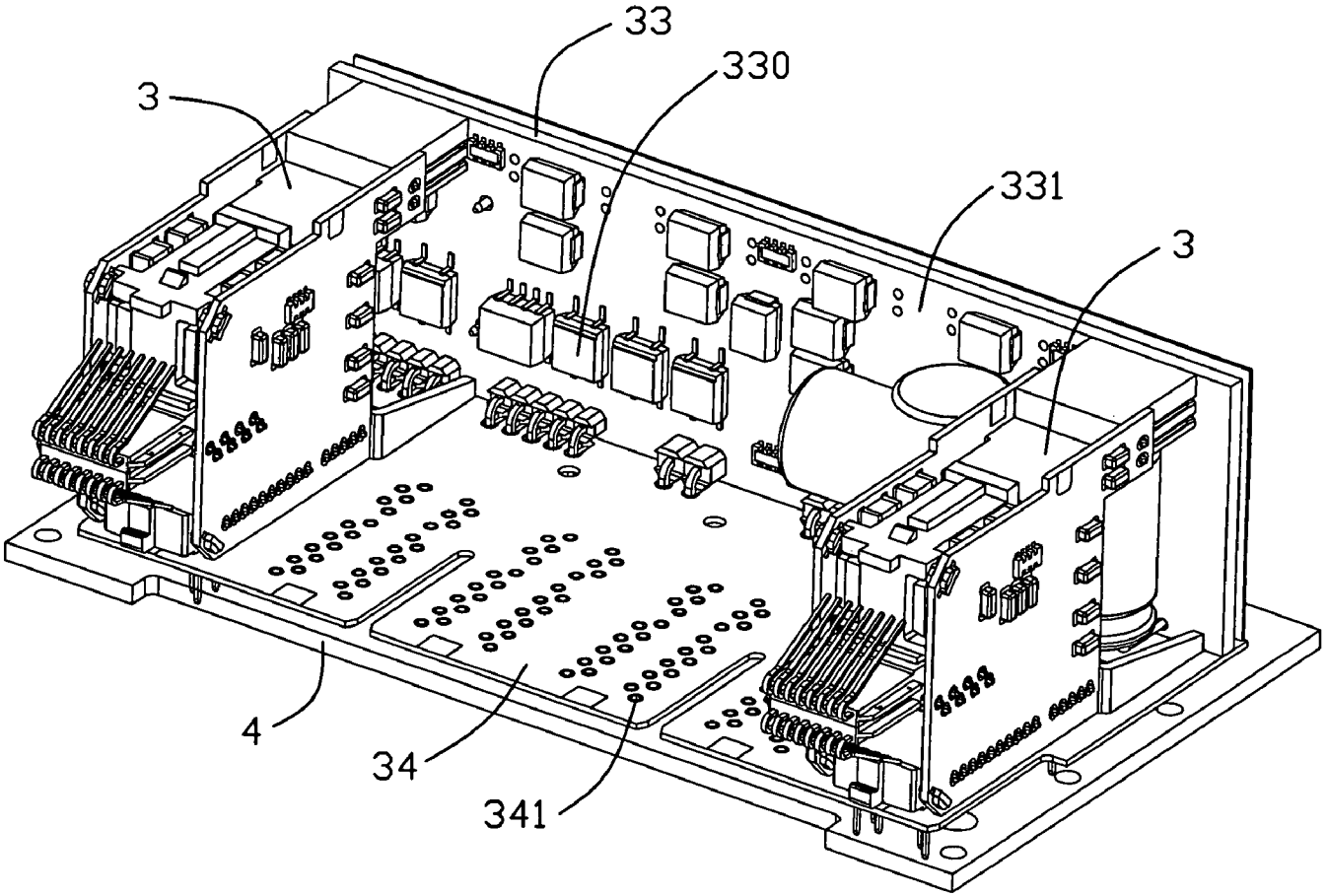
FIG. 3 is a perspective view of a power over ethernet assembly and a mother board respectively attached to a rear portion and a bottom portion of a pair of terminal modules as shown in FIG. 1.
Figure 5:
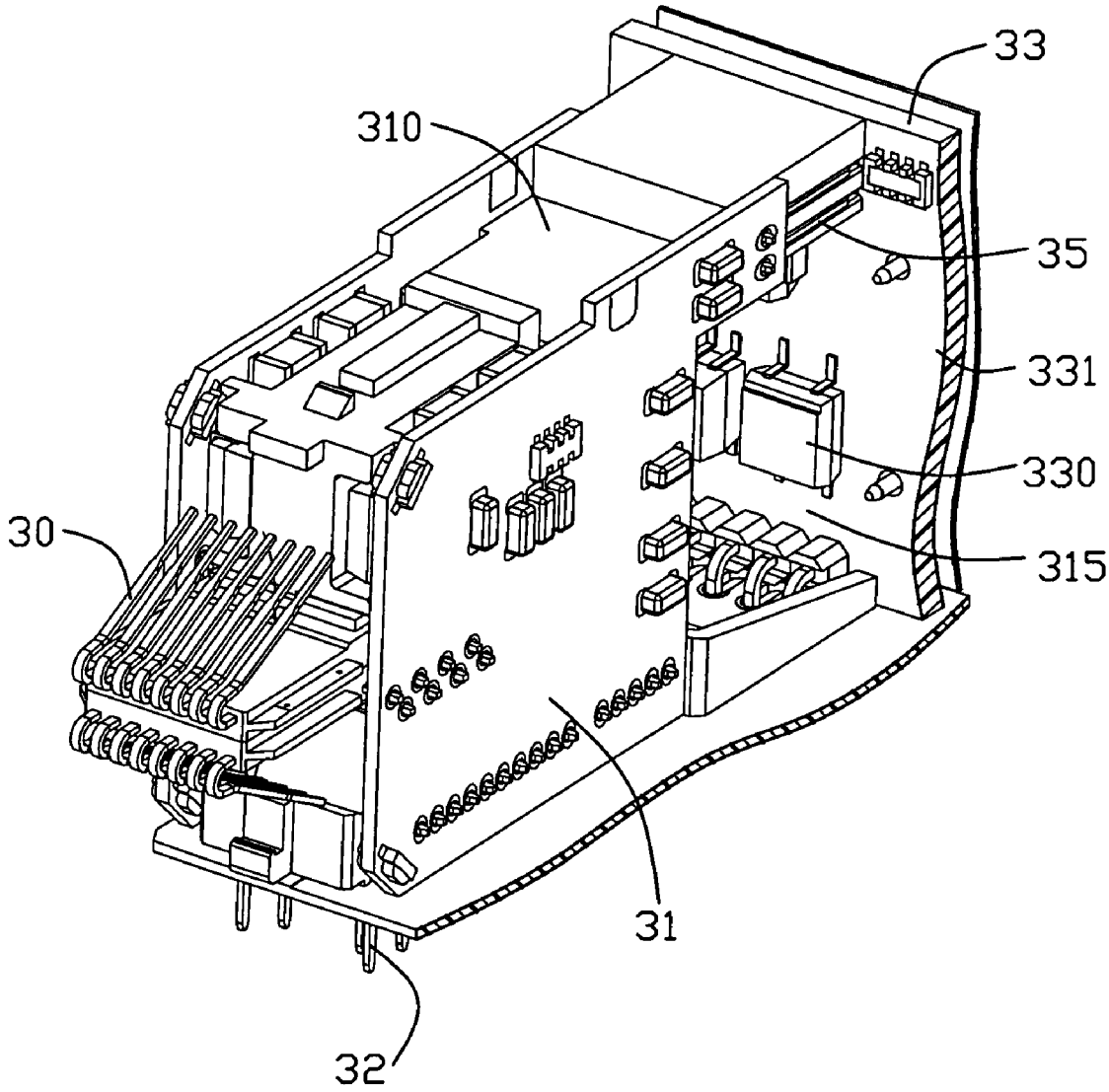
FIG. 5 is an assembled perspective view of the terminal module which is connected with the power over ethernet assembly.

Referring to FIGS. 3, 5, the power over ethernet assembly 33 is provided with a substrate 331 and a plurality of electrical elements 330 such as capacitors mounted to the substrate 331.

Referring to FIG. 2, the insulative housing 2 has a pair of lateral walls 23, a top wall 21 and a bottom wall 22 and defines a plurality of cavities 20 for receiving the mating plugs.

As shown in FIGS. 1-6, the terminal module 3 is mounted in the cavity 20 of the insulative housing 2 and comprises a contacting module 30, a base element 310, a pair of daughter boards 311 having a plurality of magnetic core 312 mounted thereon and a connecting element 32. The base element 310 has a front portion 3101, a rear portion 3102, a top portion 3103, a bottom portion 3104, a pair of opposite side portions 3107 and a pair of receiving rooms 3108 defined therebetween for receiving a plurality of magnetic cores 312 formed on the daughter boards 311, and a plurality of connecting terminals 35 mounted thereon.

The contacting module 30 is mounted to the front portion 3101 of the base element 310. The contacting module 30 has a rectangular housing 301 and two groups of mating terminals 302 in the rectangular housing 301. The mating terminals 302 have a plurality of contacting portions 3021 received in the cavities 20 of the insulative housing 2 for electrically connecting with the mating plug, and a plurality of tail portions 3022 extending perpendicularly from the housing 301 into a plurality of first holes 3110 disposed on the daughter board 311, thereby forming a conductive trace between the daughter board 311 and the contacting module 30.

Figure 6:
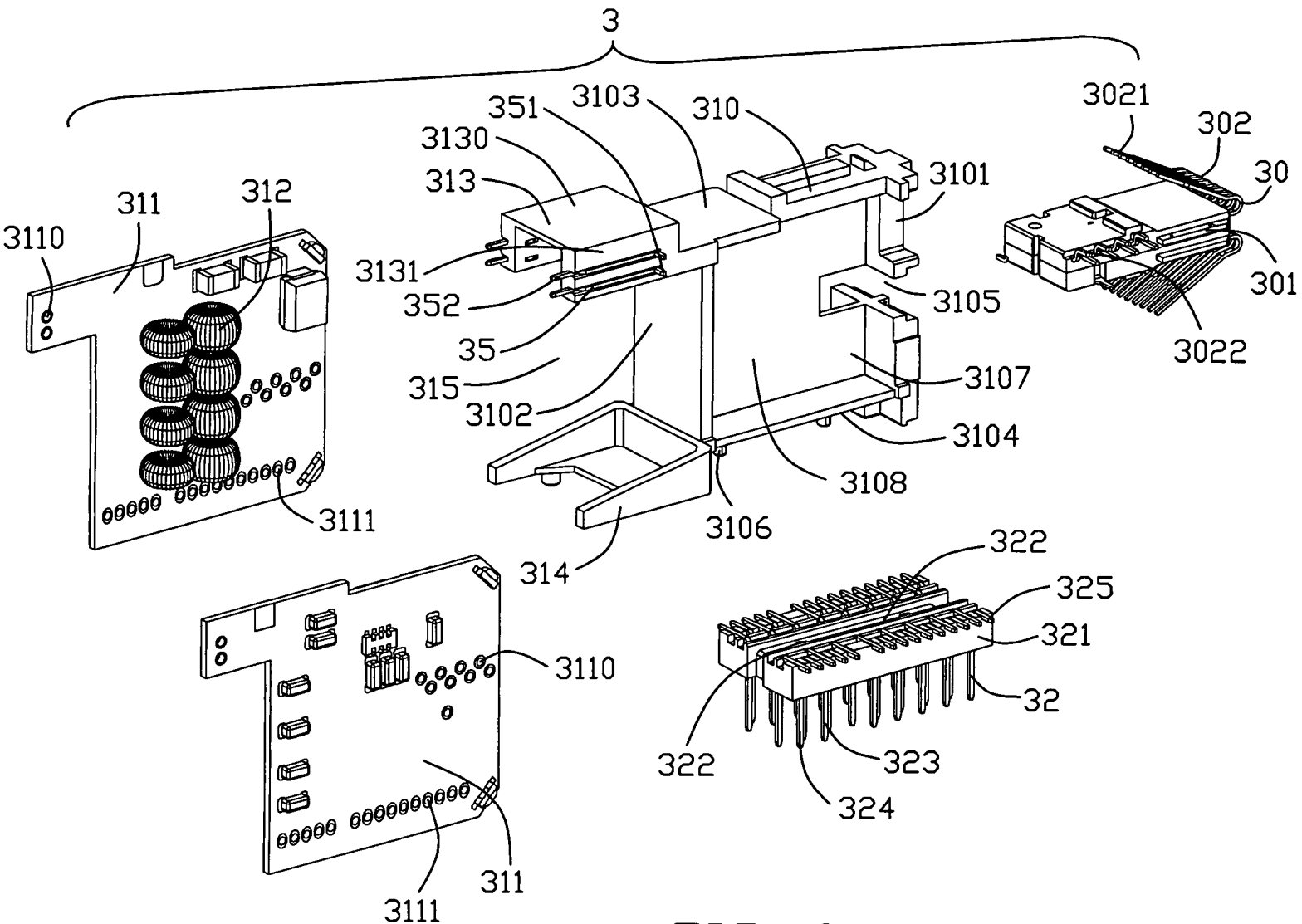
FIG. 6 is an exploded view of the terminal module as shown in FIG. 4.
Figure 7:
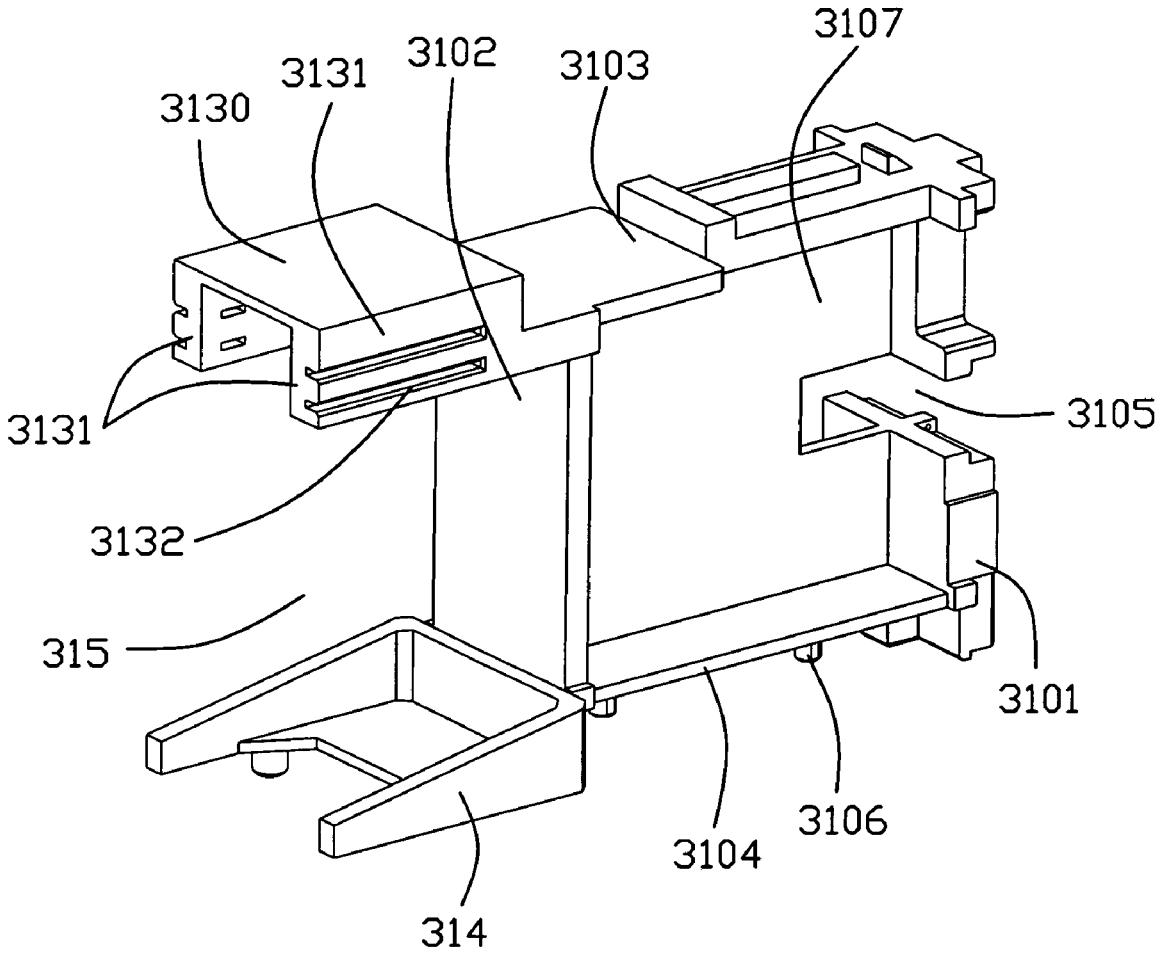
FIG. 7 is a perspective view of a base element of the terminal module.
Figure 8:
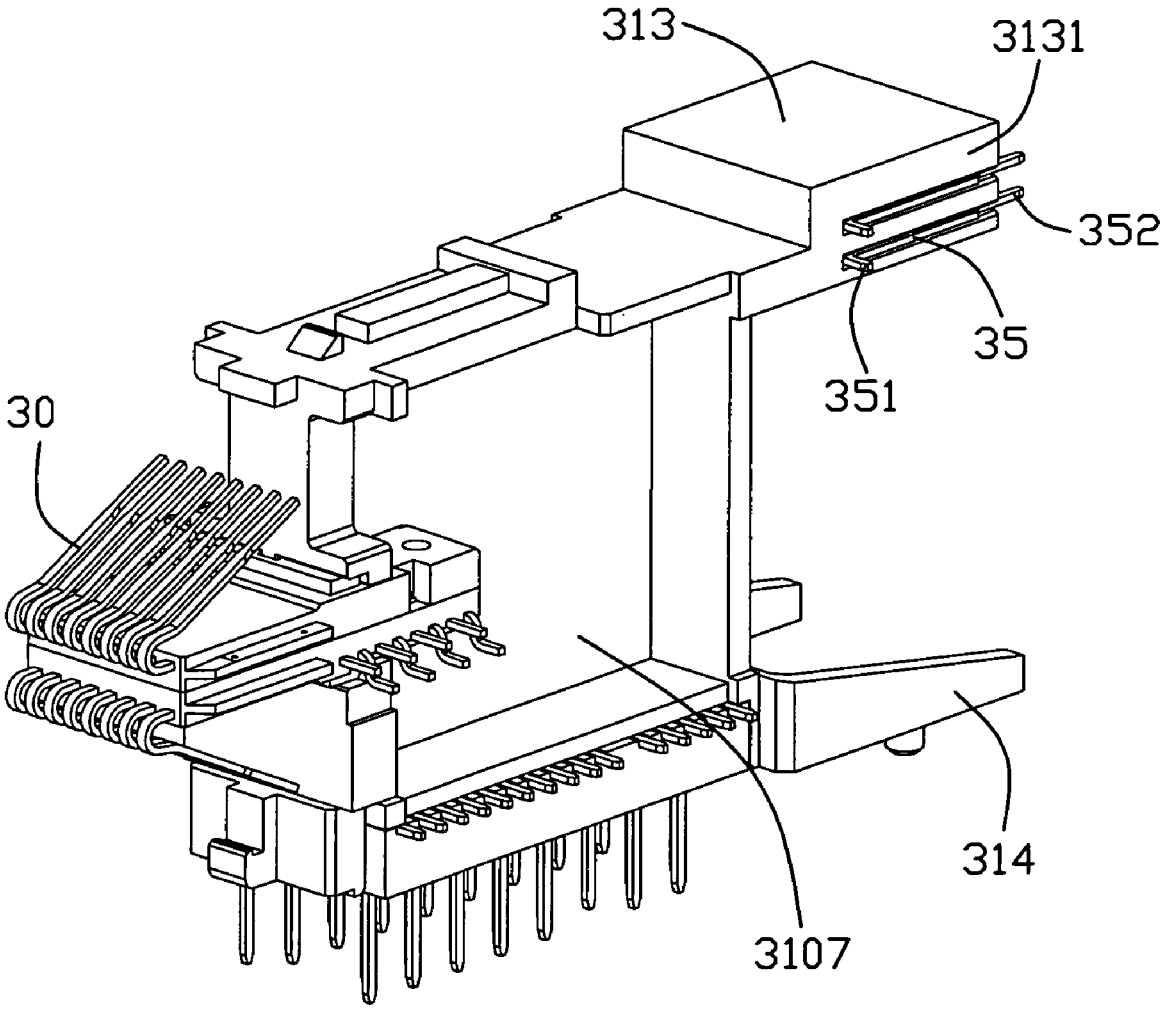
FIG. 8 is a perspective view of the base element as shown in FIG. 7 and a contacting module mounted on the base element.

As shown in FIGS. 6-8, The front portion 3101 of the base element 310 defines an opening 3105 for engaging with the rectangular housing 301 of the contacting module 30. The base element 310 further comprises a first projecting portion 313 extending rearwardly from the top portion 3103, a second projecting portion 314 extending rearwardly from the bottom portion 3104 and a second receiving space 315 defined therebetween for receiving the electrical elements 330 of power over ethernet assembly 33. The first projecting portion 313 comprises a middle portion 3130 horizontally rearwardly extending from the top portion 3103 and a pair of opposite lateral walls 3131 perpendicularly downwardly extending from the middle portion 3130. Each lateral wall 3131 defines a pair of parallel terminal slots 3132 thereon for receiving the connecting terminals 35. Each connecting terminal 35 has a front end 351 connecting with the daughter board 311, and a rear end 352 extending outwardly from the terminal slot 3132, thus electrically connecting the daughter board 311 to the power over ethernet assembly 33. The bottom portion 3104 of the base element 310 is provided with a pair of protruding posts 3106.

Figure 4:
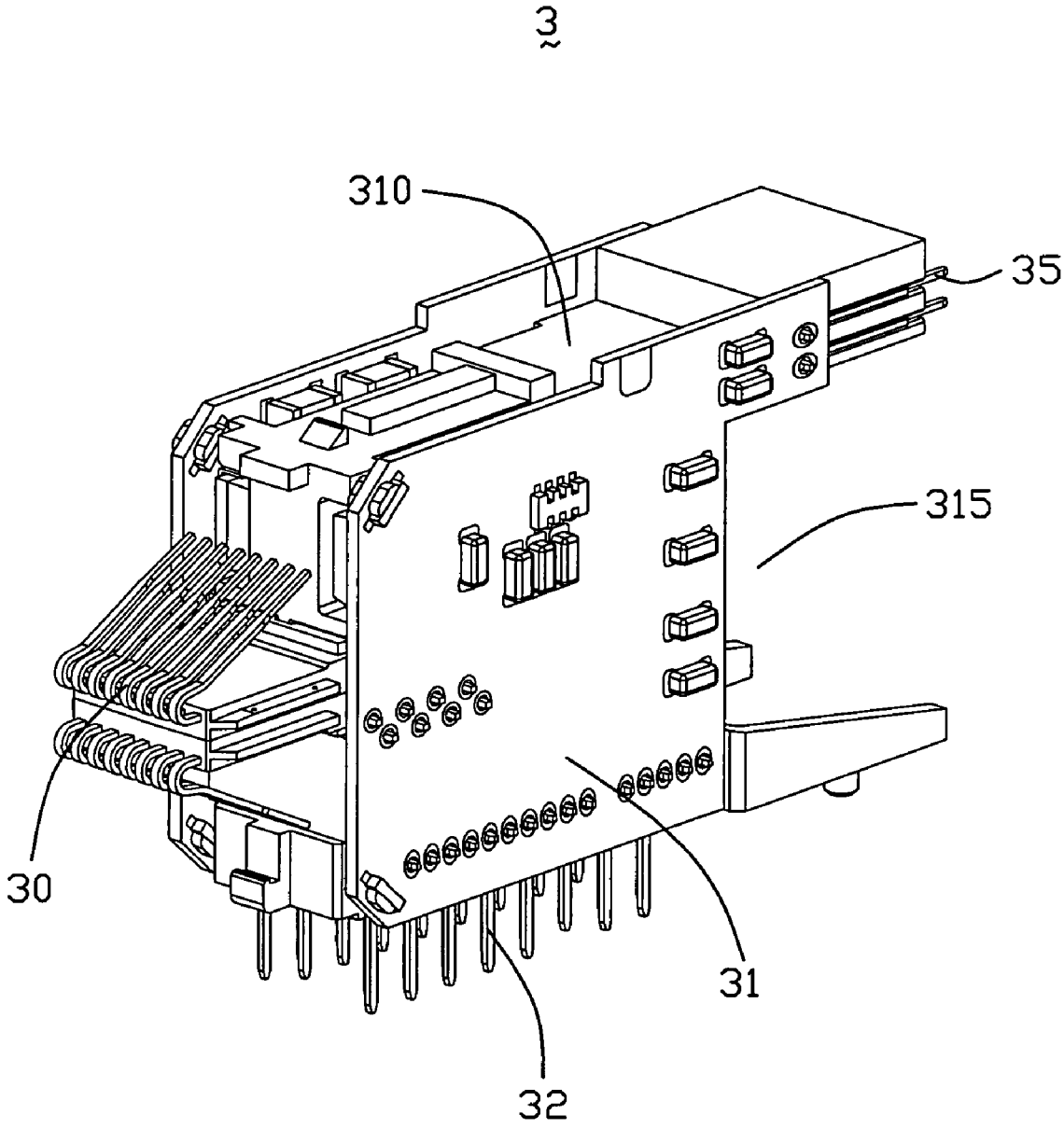
FIG. 4 is a partially assembled perspective view of the terminal module as shown in FIG. 3.

Referring to FIGS. 4-6, the connecting element 32 is mounted below the bottom portion 3104 of the base element 310. The connecting element 32 has a base section 321 defining a pair of recesses 322 thereon for engaging with a pair of protruding posts 3106 of the base element 310, and two rows of L-shaped contacts 323 assembled to the base section 321. Each row of the L-shaped contacts 323 have soldering portions 324 soldered onto the mother board 4 and bending portions 325 extending through the second holes 3111 disposed on the daughter board 311, thereby electrically forming a conductive trace between the daughter board 311 and the mother board 4.

Referring to FIG. 3, the modular jack assembly further comprises a grounding plate 34 defining a plurality of through holes 341 for extension of the L-shaped contacts 323.

Referring to FIGS. 1-8, in assembling of the modular jack assembly, firstly, the contacting module 30 is inserted into the opening 3105 of the base element 310. Secondly, the connecting element 32 is mounted below the bottom portion 3104 of the base element 310 by the engagement between the protruding posts 3106 and the recesses 322. The pair of daughter boards 31 are assembled to the side portions 3107 of base element 310 and the magnetic cores 312 of the daughter board 31 are received in the receiving room 3108. Then the power over ethernet assembly 33 is mounted to the rear of base element 310 and is electrically connected with the connecting terminals 35. The grounding plate 34 is mounted below the terminal module 3. The soldering portions 324 of the L-shaped contacts 323 extend through corresponding through holes 341 of the grounding plate 34 for being fixed at a proper position. Thirdly, the terminal module 3 is mounted in the cavity 20 of the insulative housing 2 and then the assembly is ready to be mounted to the mother board 4. The soldering portions 324 of the L-shaped contacts 323 are soldered on the mother board 4. The outer shield 6 is attached to an outer side of the insulative housing 2 for shielding purpose. The grounding plate 34 is connected to the outer shield 6 for grounding.

The terminal module 3 is electrically connected to the mother board 4 via the electrical connection among the mating terminals 302, a conductive trace of the daughter board 311 and the L-shaped contacts 323. The terminal module 3 is electrically connected to the electrical elements 330 of the power over ethernet assembly 33 via the electrical connection among the mating terminals 302, another conductive trace of the daughter board 311 and the connecting terminals 35.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A modular jack assembly for being mounted to a mother board and engaging with a mating plug, comprising:

an insulative housing mounted on said mother board and defining a cavity for receiving the mating plug;

a power over ethernet assembly having a substrate and a plurality of electrical elements mounted on the substrate; and a terminal module mounted in the insulative housing and comprising:

a base element comprising a front portion, a top portion, a bottom portion, a rear portion, a side portion, a receiving room defined therein, and a plurality of connecting terminals mounted thereon and electrically connected with the power over ethernet assembly;

a pair of daughter boards attached to opposite sides of the base element and having a conductive region electrically connected with the power over ethernet assembly;

a contacting module assembled to the front portion of the base element and having two groups of mating terminals mounted thereon, each group of mating terminals having contacting portions contacting with the mating plug and tail portions electrically connected to the conductive region of corresponding daughter board; and a connecting element mounted below the bottom portion of the base element and having two rows of contacts assembled thereto, each row of the contacts having soldering portions electrically connecting to the mother board and bending portions electrically connected to the conductive region of corresponding daughter board;

wherein said terminal module is electrically connected to the mother board via the electrical connection among the mating terminals, the conductive region of the daughter board and the contacts, and wherein the terminal module is electrically connected to the power over ethernet assembly via the electrical connection among the mating terminals, the conductive region of the daughter board and the connecting terminals.

2. The modular jack assembly as claimed in claim 1, wherein said base element further comprises a first projecting portion extending rearwardly from the top portion, a second projecting portion extending rearwardly from the bottom portion, and a second receiving space defined therebetween for receiving the electrical elements of the power over ethernet assembly.

3. The modular jack assembly as claimed in claim 2, wherein said first projecting portion of the base element defines a plurality of slots for partially receiving the connecting terminals, the connecting terminals having front ends extending through a plurality of second holes disposed on the daughter board and rear ends electrically connected to the substrate of power over ethernet assembly.

4. The modular jack assembly as claimed in claim 1, wherein said daughter board has a plurality of magnetic cores mounted thereon and received in the receiving room of the base element.

5. The modular jack assembly as claimed in claim 1, wherein said front portion of base element defines an opening, and wherein said contacting module has a housing engaging within the opening of the front portion.

6. The modular jack assembly as claimed in claim 5, wherein said mating terminals are mounted to the housing and the contacting portions are received in the cavity of the insulative housing for electrically connecting with the mating plug.

7. The modular jack assembly as claimed in claim 1, wherein said connecting element comprises a base section for fixing the contacts, and wherein said daughter board defines a plurality of first holes on a lower edge thereof for engaging with the bending portions of the contacts.

8. The modular jack assembly as claimed in claim 7, wherein said bottom portion of the base element has a pair of protruding posts engaging with a pair of corresponding recesses disposed on the base section of the connecting element.

9. The modular jack assembly as claimed in claim 1, further comprising an outer shield attached to the insulative housing.

10. The modular jack assembly as claimed in claim 9, further comprising a grounding plate connected to the outer shield and mounted between the insulative housing and the mother board, and wherein the grounding plate defining thereon a plurality of through holes for extension of the contacts.

11. A modular jack assembly comprising:

an insulative housing;

a plurality of terminals located around a front portion of the housing;

a first printed circuit board (PCB) vertically located on one lateral side of the housing and defining a first plane extending along a front-to-back direction, tails of said terminals electrically and mechanically connected to a front edge region of said first PCB;

a plurality of first mounting contacts connected to a lower edge region of the first PCB for mounting to a mother board under the housing;

a second printed circuit board (PCB) vertically located on a rear side of the housing and defining a second plane perpendicular to said front-to-back direction;

a plurality of connection terminals connected between the first PCB and the second PCB; and a plurality of second mounting contacts connected to a lower edge area of the second PCB and located behind the first mounting contacts for mounting to the mother board.

12. The modular jack assembly as claimed in claim 11, wherein the connection terminals are located between an upper rear region of the first PCB and an upper area of the second PCB.

13. The modular jack assembly as claimed in claim 11, wherein the first mounting contacts are arranged in one row along said front-to-back direction.

14. The modular jack assembly as claimed in claim 13, wherein said connection terminals are arranged in one row along a vertical direction perpendicular to said front-to-back direction.

15. The modular jack assembly as claimed in claim 14, wherein said second mounting contacts are arranged in one row along a lateral direction perpendicular to said front-to-back direction and said vertical direction.

* * * * *